US012054996B2

(12) United States Patent
Elsayed

(10) Patent No.: US 12,054,996 B2
(45) Date of Patent: Aug. 6, 2024

(54) MULTIFUNCTIONAL DRILLING ENHANCEMENT TOOL AND METHOD

(71) Applicant: KING ABDULLAH UNIVERSITY OF SCIENCE AND TECHNOLOGY, Thuwal (SA)

(72) Inventor: Shehab Ahmed Mohamed Ahmed Elsayed, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 315 days.

(21) Appl. No.: 17/766,818

(22) PCT Filed: Oct. 6, 2020

(86) PCT No.: PCT/IB2020/059382
§ 371 (c)(1),
(2) Date: Apr. 6, 2022

(87) PCT Pub. No.: WO2021/070057
PCT Pub. Date: Apr. 15, 2021

(65) Prior Publication Data

US 2023/0313621 A1 Oct. 5, 2023

Related U.S. Application Data

(60) Provisional application No. 62/930,047, filed on Nov. 4, 2019, provisional application No. 62/911,618, filed on Oct. 7, 2019.

(51) Int. Cl.

| | |
|---|---|
| ***E21B 10/26*** | (2006.01) |
| ***E21B 17/046*** | (2006.01) |
| ***E21B 17/06*** | (2006.01) |

(52) U.S. Cl.
CPC ..... *E21B 17/046* (2013.01); *E21B 10/26* (2013.01); *E21B 17/06* (2013.01)

(58) Field of Classification Search
CPC ..... E21B 10/26; E21B 10/30; E21B 17/1064; E21B 17/1078
See application file for complete search history.

(56) References Cited

U.S. PATENT DOCUMENTS 2,495,364 A * 1/1950 Clapp ..... E21B 4/10 175/298
3,257,827 A * 6/1966 Hughes ..... E21B 17/073 175/320

(Continued)

FOREIGN PATENT DOCUMENTS

WO 2018094318 A1 5/2018

OTHER PUBLICATIONS

International Search Report in corresponding/related International Application No. PCT/IB2020/059382, date of mailing Jan. 18, 2021.

(Continued)

*Primary Examiner* — Kipp C Wallace
(74) *Attorney, Agent, or Firm* — PATENT PORTFOLIO BUILDERS PLLC

(57) ABSTRACT

A multifunctional drilling enhancement tool includes a shaft having a bore extending along a longitudinal direction (X); a main cutting device rotatably and slidably attached to the shaft; a first housing fixedly attached to a first end of the shaft; a second housing fixedly attached to a second end of the shaft; first and second proximal engagement elements attached to opposite ends of the main cutting device; and first and second distal engagement elements attached to corresponding ends of the first and second housings, so that the first distal engagement element is directly facing the first proximal engagement element, and the second distal (Continued)

engagement element is directly facing the second proximal engagement element. The first distal engagement element has removable first distal inserts, the first proximal engagement element has removable first proximal inserts, and the first distal inserts are configured to directly contact the first proximal inserts to transmit a rotation from the first housing to the main cutting device.

19 Claims, 12 Drawing Sheets

(56) References Cited

U.S. PATENT DOCUMENTS

| | | | | |
|---|---|---|---|---|
| 3,767,263 | A * | 10/1973 | Gootee | E21D 9/0879 299/56 |
| 6,935,442 | B2 | 8/2005 | Boulet et al. | |
| 8,381,843 | B1 | 2/2013 | Lamontagne | |
| 10,378,280 | B2 * | 8/2019 | Carter | E21B 3/035 |
| 2012/0132469 | A1 * | 5/2012 | Robson | E21B 10/62 175/73 |
| 2019/0360280 | A1 * | 11/2019 | Ahmed | E21B 17/00 |

OTHER PUBLICATIONS

Written Opinion of the International Searching Authority in corresponding/related International Application No. PCT/IB2020/059382, date of mailing Jan. 18, 2021.

* cited by examiner

MULTIFUNCTIONAL DRILLING ENHANCEMENT TOOL AND METHOD

CROSS-REFERENCE TO RELATED APPLICATIONS

This application is a U.S. National Stage Application of International Application No. PCT/IB2020/059382, filed on Jun. 10, 2020, which claims priority to U.S. Provisional Patent Application No. 62/911,618, filed on Oct. 7, 2019, entitled "MULTIFUNCTIONAL DRILLING ENHANCEMENT TOOL," and U.S. Provisional Patent Application No. 62/930,047, filed on Nov. 4, 2019, entitled "MULTIFUNCTIONAL DRILLING ENHANCEMENT TOOL," the disclosures of which are incorporated herein by reference in their entirety.

BACKGROUND

Technical Field

Embodiments of the subject matter disclosed herein generally relate to a drilling enhancement tool for use in a well, and more particularly, to a tool for carrying out multiple functions typically addressed using multiple drilling tools in a well.

Discussion of the Background

Well drilling has developed into a precision industry not only for the oil and gas sector, but also for the water exploration sector. Some boreholes are being made to follow precisely predetermined paths through the earth and are being precisely sized (conditioned) for the installation of casing to line the borehole, as well as to facilitate re-entry using open hole logging tools. This precision is accomplished by means of specialized tools and equipment installed with a drill string bottom hole assembly, i.e., that portion of the drill string between the bit at the lowermost distal end up to the remainder of the drill string.

One commonly used bottom hole tool is the stabilizer, which is installed in the bottom hole assembly to reduce or preclude excessive lateral movement or oscillation of the drill string during drilling operations. Stabilizers are provided with diameters substantially equal to the diameter of the borehole, which is determined by the cutting diameter of the bit being used.

In some cases, the borehole is undersized at certain points, i.e., has a diameter less than that desired one for the installation of casing, etc. This may be caused by various factors, such as hard rock structures that intrude into the bore hole even after the bit has passed. Such intrusions are normally removed by the installation of a roller reamer to the bottom hole assembly, then positioning the reamer at the desired depth and operating the drill string to ream out the intrusion.

Such specialized earth boring tools as stabilizers and roller reamers are generally manufactured as single special purpose devices, and are not well suited for other roles than their specific purposes. Keyseat wipers (i.e., devices to widen a portion of a bore hole where the drill string has cut into the side of the passage to form a keyhole-shaped cross section), as well as fixed blade cutters, are also typically used in a drill string configuration to assist in wellbore conditioning. A keyseat wiper is used to remove keyseats that develop during the drilling process. Fixed blade cutters are also typically used when roller reamers alone cannot provide the needed wellbore conditioning. Friction reducers are also used in a bottom hole assembly to reduce the torque resistance in deviated wells, i.e., wells that deviate from the vertical direction. They allow free rotation of the drill string at the dog leg, which adds power to the bit, increases the rate of penetration, and decreases the fatigue of the drill string and rotary equipment. A typical drill string would require a combination of such tools to complete the drilling operation.

Thus, a multifunction wellbore conditioning tool solving the aforementioned problems is desired and was presented in International Patent Application WO 2018/094318 (herein, "the '318 application"), the entire content of which is incorporated herein by reference. One embodiment of the '318 application is shown in FIG. 1 (which corresponds to FIG. 1 of the '318 application) and is briefly discussed herein. The multifunction wellbore conditioning tool, or simply the tool 100, includes an elongate, rigid central shaft 102 having a first end portion 104, a central portion 106, and a second end portion 108, opposite the first end portion 104. Cylindrical first and second housings 110 and 120 are affixed rotationally and axially (i.e., immovably affixed) concentrically to the first end portion 104 and the second end portion 108, respectively, of the shaft 102.

A working sleeve 114 is installed about the central portion 106 of the shaft 102 between the first and second housings 110 and 112, and is free to move rotationally and axially relative to the shaft 102, unless it is locked with one of the two housings 110 and 112, as described further below. The sleeve 114 has a first end portion 116, a central portion 118, and a second end portion 120 opposite the first end portion 116. The working sleeve (sleeve 114) includes a plurality of straight or helically disposed external cutting elements 122 separated by straight or helical flutes 124 therebetween, the cutting elements 122 permitting the sleeve 114 to function as a combination of a cutter, keyseat wiper, friction reducer, reamer, keyseat wiper, and stabilizer. Rotational and axial translational friction between the sleeve 114 and shaft 102 is reduced by a ball bearing system 126, which is disposed between the shaft 102 and the working sleeve 114. The ball bearing system 126 extends along the longitudinal axis of the shaft 102 as much as the sleeve 114.

The working sleeve 114 is retained in a neutral position on the central portion 106 of the shaft 102, clear of the two housings 110 and 112, by first and second spring sets 134 and 136. The first and second spring sets 134 and 136 are installed concentrically about the shaft 102, between the first end 104 and the central portion 106 and between the second end 108 and the central portion 106, respectively, of the shaft 102. The first and second spring sets 134 and 136 are provided within the first and second housings 110 and 112 to bear against the first and second spring seat **140*a* and second spring seat 140*b*. The first and second spring seats 140*a* and 140*b* are connected to ends 116 and 120 respectively, of the working sleeve 114. The first spring 134 is secured to a first thrust transmitting system 138*a* and the first spring seat 140*a*, and the second spring 136 is secured to a second thrust transmitting system 138*b* and the second spring seat 140*b* in a similar manner, but in a mirror image to the first spring 134 and its corresponding thrust transmitting system 138*a* and spring seat 140*a*. Thus, the first spring 134, first thrust transmitting system 138*a*, and first spring seat 140*a* are rotationally fixed to one another, as are the second spring 136, second thrust transmitting system 138*b*, and second spring seat 140*b*. The two thrust transmitting systems 138*a*, 138*b* are either retained within their respective housings 110 and 112 by keys that are inserted into corresponding keyholes or slots in the sides of the housings 110 and 112, and into outer circumferential grooves formed about the two thrust transmitting system 138***a*, 138*b*, or, retained to the shaft by thrust carrying disc 142 attached to the shaft and into inner circumferential grooves formed about the two thrust transmitting systems 138*a*, 138*b*. This construction allows the working sleeve 114 to rotate freely relative to the shaft 102. This also allows the two springs 134, 136 to work together to create a spring assembly of equivalent stiffness equal to the combined stiffness of the individual springs depending on the spring sets attachment technique. When installed, the ends of the two springs 134 and 136 are fixedly connected to the ball bearing system 126 so that a force applied to one spring is transmitted to the other spring. In other words, the two springs are not independent of each other.

Each housing 110, 112 has a sleeve engagement end 150*a* and 150*b*, that are facing one another. The working sleeve 114 has first and second housing engagement ends 152*a* and 152*b*, disposed about the respective opposite first and second end portions 116 and 120 of the sleeve. The sleeve engagement end 150*a* of the first housing 110 and the adjacent housing engagement end 152*a* of the first end portion 116 of the working sleeve 114 collectively form a first clutch mechanism. Similarly, the sleeve engagement end 150*b* of the second housing 112 and the adjacent housing engagement end 152*b* of the second end portion 120 of the working sleeve 114 collectively form a second clutch mechanism. The first and second clutch mechanisms include first and second dog clutches, i.e., mechanisms that lock up abruptly to apply full drill string torque to the working sleeve 114 due to sudden solid contact between mating teeth or other protrusions of the clutch mechanism.

The first dog clutch mechanism of the tool 100 includes a first pair of axially oriented teeth or faces 154*a* on the sleeve engagement end 150*a* of the first housing 110, which selectively engage corresponding teeth or faces 156*a* extending from the sleeve engagement end 152*a* of the first end portion 116 of the sleeve 114. The teeth 154*a* of the first housing 110 are circumferentially distributed and separated by protruded ramps. Similarly, the teeth 156*a* of the first end portion 116 of the sleeve 114 are circumferentially distributed and have spiral ramps extending therebetween. This construction causes the first dog clutch to lock up, i.e., to cause the working sleeve 114 to rotate in unison with the housing 110 (and thus the shaft 102) when the shaft 102 and housing 110 are rotating in a clockwise direction when viewed from above. However, the ramp configuration between the teeth allows the dog clutch mechanism to slip when the housing 110 rotates counterclockwise relative to the sleeve 114. Thus, if the working sleeve 114 encounters axial resistance sufficient to override the compression of the first spring 134 and the tensile force of the second spring 136, or the corresponding stack of disc springs used instead, and force the two components of the first dog clutch into engagement with one another, the sleeve 114 will be forced into rotation in unison with the shaft 102 and housing 110 by engagement of the first dog clutch mechanism, thereby reaming or otherwise conditioning the borehole by application of the full drill string torque to the working sleeve 114 as drilling continues.

In the event that the working sleeve 114 "hangs up" or is caught on some protrusion as the drill string (and thus the shaft 102) is withdrawn from the borehole, the shaft 102 will be drawn upward through the sleeve 114. If sufficient tensile force is applied to the sleeve 114, it will cause the second spring 136 to compress and the first spring 134 to extend to the extent that the two sets of dog clutch teeth 154*b* and 156*b* of the second end of the assembly will engage. It is noted that this engagement will only occur if the shaft 102 (and the second housing 112 immovably affixed thereto) is rotating in a clockwise direction when viewed from above. Rotation of the shaft 102 and housing 112 in the opposite direction will allow the sloped or ramp surfaces to slide relative to one another, without rotary engagement of the working sleeve 114. It will be seen that the orientation of the sloped surfaces between each of the axial teeth 154*a*, 156*a* and 154*b*, 156*b* may be reversed for drill strings that rotate in a counterclockwise direction.

However, the system discussed above with regard to FIG. 1 may engage the teeth 154*a*, 156*a* and 154*b*, 156*b* suddenly, which sometimes may result in one or more teeth wearing prematurely. For this situation, the tool needs to be taken apart and the clutching mechanisms need to be replaced, which is expensive. In addition, when the tool 100 is deployed in curved wells, it is possible that the shaft 102 slightly bends due to the curved profile of the well while the ball bearing system 126, which supports the entire length of the sleeve 114, still rotates. For this situation, the ball bearing system 126 might fail as this system is not designed to bend. Further, because the springs 134 and 136 are each fixedly attached with one end to the ball bearing system, when a force is applied to one spring, that force is automatically transmitted to the other spring, which in some situations is undesirable. Furthermore, if the well deforms prior to installing the casing, and an interior diameter of the well becomes smaller (i.e., forms a constriction), the tool 100 cannot pass the constriction and other tools need to be lowered into the well to regain the original diameter of the well.

All these potential problems require a new system that is capable of avoiding the possible failings of the tools discussed above.

BRIEF SUMMARY OF THE INVENTION

According to an embodiment, there is a multifunctional drilling enhancement tool that includes a shaft having a bore extending along a longitudinal direction (X), a main cutting device rotatably and slidably attached to the shaft, a first housing fixedly attached to a first end of the shaft, a second housing fixedly attached to a second end of the shaft, first and second proximal engagement elements attached to opposite ends of the main cutting device, and first and second distal engagement elements attached to corresponding ends of the first and second housings, so that the first distal engagement element is directly facing the first proximal engagement element, and the second distal engagement element is directly facing the second proximal engagement element. The first distal engagement element has removable first distal inserts, the first proximal engagement element has removable first proximal inserts, and the first distal inserts are configured to directly contact the first proximal inserts to transmit a rotation from the first housing to the main cutting device.

According to another embodiment, there is a multifunctional drilling enhancement tool that includes a main cutting device rotatably and slidably attached to a shaft, a first housing fixedly attached to a first end of the shaft, a second housing fixedly attached to a second end of the shaft, a first secondary cutting device formed on an outside of the first housing, and a second secondary cutting device formed on an outside of the second housing.

According to yet another embodiment, there is a method for conditioning a drill hole in a well, and the method includes attaching a tool between a drilling element and a drill line, wherein the tool has a main cutting device located centrally, and first and second secondary cutting devices located at the ends of the tool, lowering the tool and the drilling element in a well, rotating the tool with the drill line so that either the first or the second secondary cutting device cuts into a constriction formed in the well, raising the tool from the well, and replacing one or more inserts attached to a proximal or distal engagement element. The proximal or distal engagement element is configured to transmit a rotation from a first or second housing to the main cutting device.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a multifunctional drilling enhancement tool.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a drilling enhancement tool capable of carrying out multiple functions in introduced and these functions are typically addressed by multiple drilling tools. The tool includes new cutting structures on the tool housing, which expands the tool's capability to cut through swelling or irregular formations. In one application, the tool has an improved mechanism for engagement of the rotating body with the tool housing such that inserts of the clutching mechanism can be replaced when worn. In another application, the tool has a new bearing design to allow the tool to slightly bend along curved wells. In one application, the tool has new internal independent top and bottom housing spring design so that the application of a force on one spring does not affect or is not transmitted to the other spring.

Figure 2:
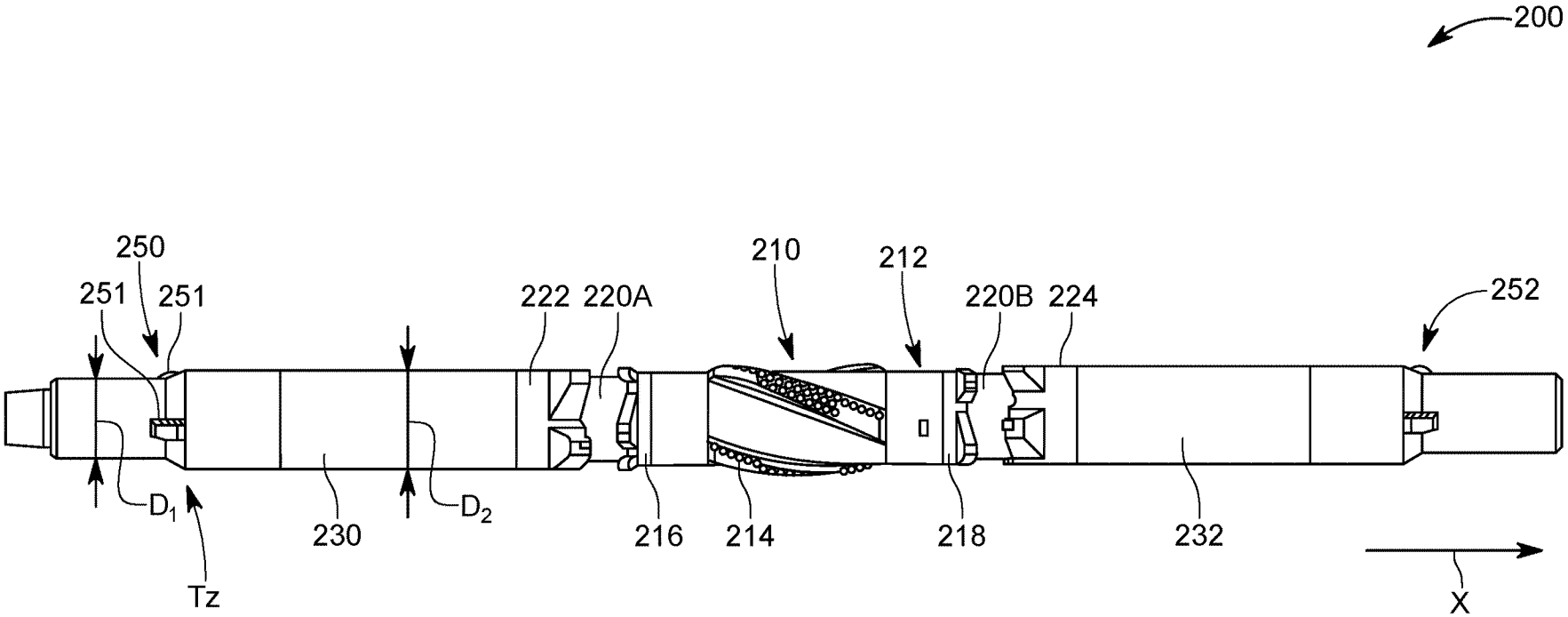
FIG. 2 illustrates a novel multifunction drilling enhancement tool for wellbore conditioning.
Figure 3:
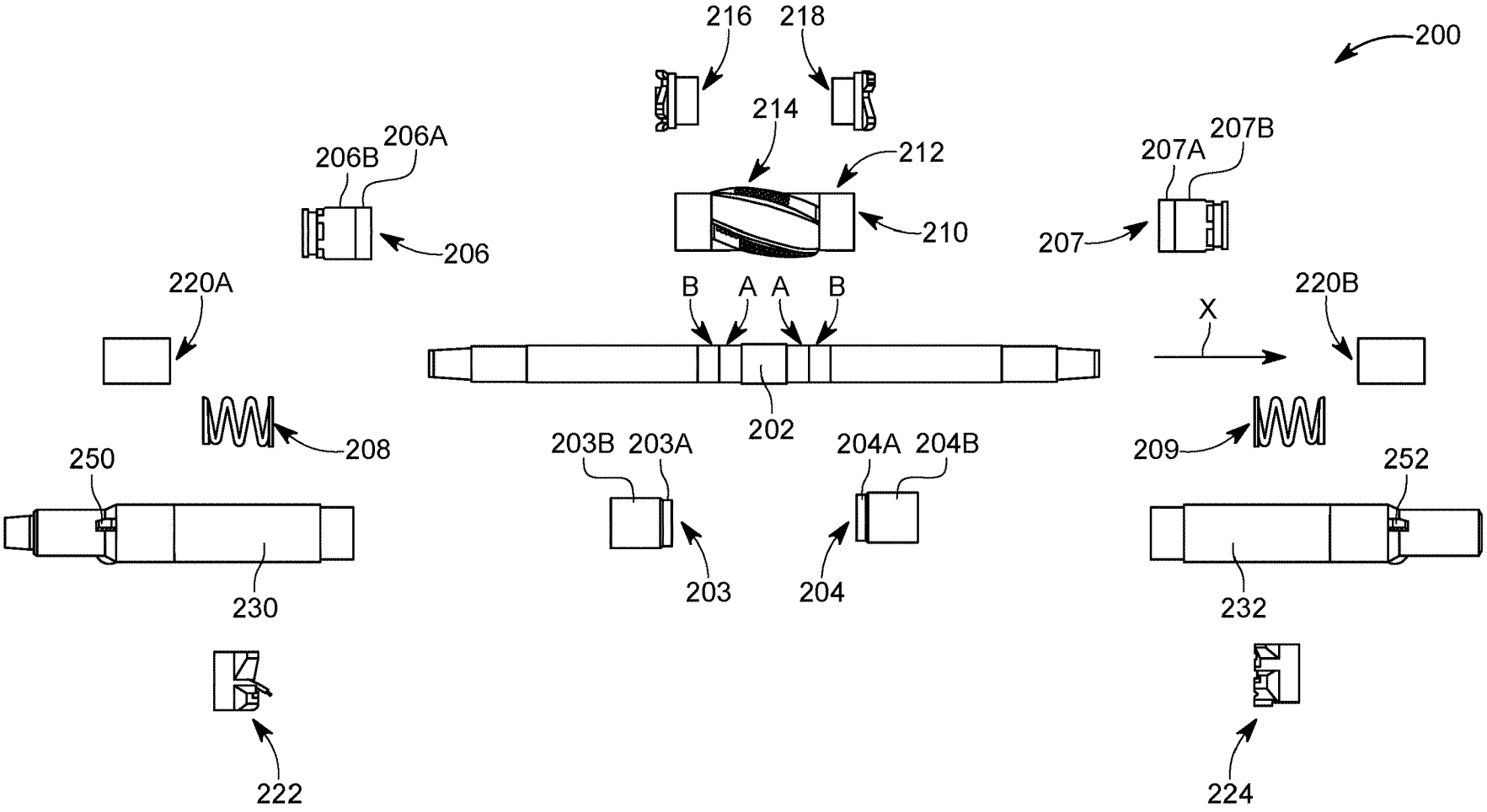
FIG. 3 is an exploded view of the multifunction enhancement tool shown in FIG. 2.

As illustrated in FIG. 2, the new multifunctional drilling enhancement tool 200, called herein simply "the tool," has a main cutting device 210 located in a central region and secondary cutting devices 250 and 252, located at the ends of the tool 200. The main cutting device 210 has a sleeve 212 that extends axially (along the longitudinal axis X), and plural cutting elements 214 formed on the sleeve 212. The cutting elements 214 may be made of a strong material, for example, polycrystalline diamond (PDC) compacts and they may be located on the sleeve to have any shape, size, and number. The sleeve 212 is attached (for example, with threads), at each end, to a corresponding proximal engagement element 216 and 218, as also shown in FIG. 3. FIG. 3 is an exploded view of the tool 200 that illustrates the internal components of the tool that are not visible in FIG. 2.

Protective sleeves 220A and 220B are provided adjacent and partially within each of the proximal engagement element 216 and 218, as shown in FIG. 2. Because the ends of the sleeves 220A and 220B are located inside the corresponding engagement elements 216 and 218, the protective sleeves act as a sealing system, which prevents the debris and fluids from the well to enter inside the tool 200.

The other ends of the sleeves 220A and 220B are located inside distal engagement elements 222 and 224, which are attached to corresponding housings 230 and 232. Each of the proximal and distal engagement elements have corresponding inserts, which are discussed in more detail later. The housing 230 is configured to hold the secondary cutting device 250 while the housing 232 is configured to hold the secondary cutting device 252. In one implementation, the housing 230 has a first external diameter D1, at the distal end from the main cutting device 210, and a second external diameter D2, at the proximal end relative to the main cutting device 210, where D1 is smaller than D2. The secondary cutting device 250 is located at the transition zone TZ, between the first diameter D1 and the second diameter D2, and may include one or more cutting elements 251 distributed along the transition zone. Each cutting element 251 may include a substrate to which a hard material shaped for cutting is attached to. In one embodiment, as illustrated in FIG. 2, the secondary cutting device 250 includes three cutting elements 251 (note that the third cutting element is not visible). The second housing 232 and the secondary cutting device 252 may have the same configuration and diameters as the first housing 230 and the associated secondary cutting device 252, but in reverse order.

FIG. 3 shows the tool 200 in an exploded view. It is noted that a shaft 202, which holds together all the elements discussed above, is not visible in FIG. 2, but it extends longitudinally, along axis X, throughout the tool 200. Also not visible in FIG. 2, there are rotational bearing devices 203 and 204. The bearing devices 203 and 204, called herein radial bearing devices, are configured to be movably attached with an inner race to the shaft 202, i.e., they can move along the axis X, an outer race can rotate relative to the shaft 202 when the main cutting device 210 is attached to the outer races of the radial bearing devices 203 and 204. The radial bearing devices 203 and 204 include the inner races 203A, 204A, respectively, which are configured to slide relative to the shaft 202, at corresponding positions A. The radial bearing devices 203 and 204 also have the outer races 203B, 204B, respectively, which are configured to directly face the inner surface of the main cutting device 210. In this way, the main cutting device 210 can rotate relative to the shaft 202, and also can translate along the longitudinal axis X (axial direction) of the shaft. Because the radial bearing devices 203 and 204 are placed, when the tool 200 is fully assembled, completely beneath the main cutting device 210, the bearing devices are not visible in FIG. 2. It is noted that because there are two radial bearing devices, that contact the main cutting device 210 only at its ends, a slight bending of the shaft 202 would not place a large strain on the two radial bearing devices, thus reducing the risk of breaking.

Also not visible in FIG. 2, but part of the tool 200, are axial ball bearing systems 206 and 207, which are illustrated in FIG. 3, and they are configured to limit an axial motion of the main cutting device 210. The axial ball bearing systems 206 and 207 are configured to only be able to rotate relative to the shaft 202, and not to move axially relative to the shaft 202. Each of the axial ball bearing systems 206 and 207 includes an inner race 206A, 207A, respectively, which is in direct contact with the shaft 202, and an outer race 206B, 207B, respectively, which is in direct contact with the housings 230 and 232, respectively. The housings 230 and 232 are configured to not move relative to the shaft 202, i.e., neither axially nor circularly. Thus, the housings 230 and 232 are fixedly attached to the shaft 202, for example, by using threads.

Figure 4:
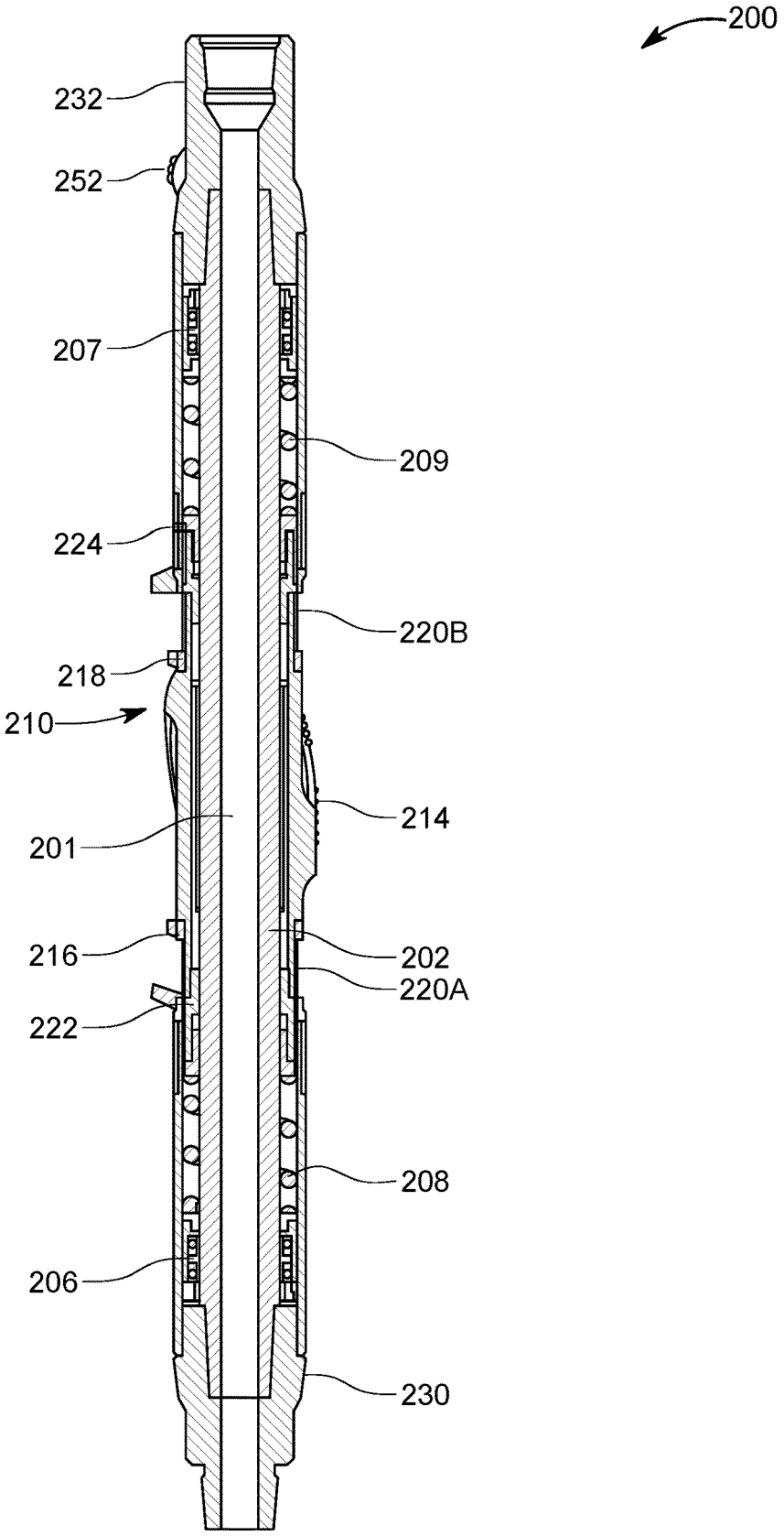
FIG. 4 is a longitudinal cross-sectional view of the multifunction enhancement tool shown in FIG. 2.

To maintain the main cutting device 210 centered between the first and second housings 230 and 232, a first spring device 208 is placed between the radial bearing device 203 and the axial ball bearing system 206, and a second spring device 209 is placed between the radial bearing device 204 and the axial ball bearing system 207. To protect the bearing systems from debris and various liquids present in the well, the protective sleeves 220A and 220B are provided between and under the proximal and distal engagement elements 216, 218, 222, and 224. FIG. 4, which is a longitudinal cross-section of the tool 200, show all these elements and the relationships between them. Note that the shaft 202 has a bore 201 that extends all the way through the tool 200, to provide fluid communication from above the tool to below the tool for the other devices that are lowered into the well, e.g., the drilling bit. Also, the first and second housings 232 and 230 are shaped to engage with standard drill strings (not shown), which are typically used in the oil and gas exploration.

Figure 5:
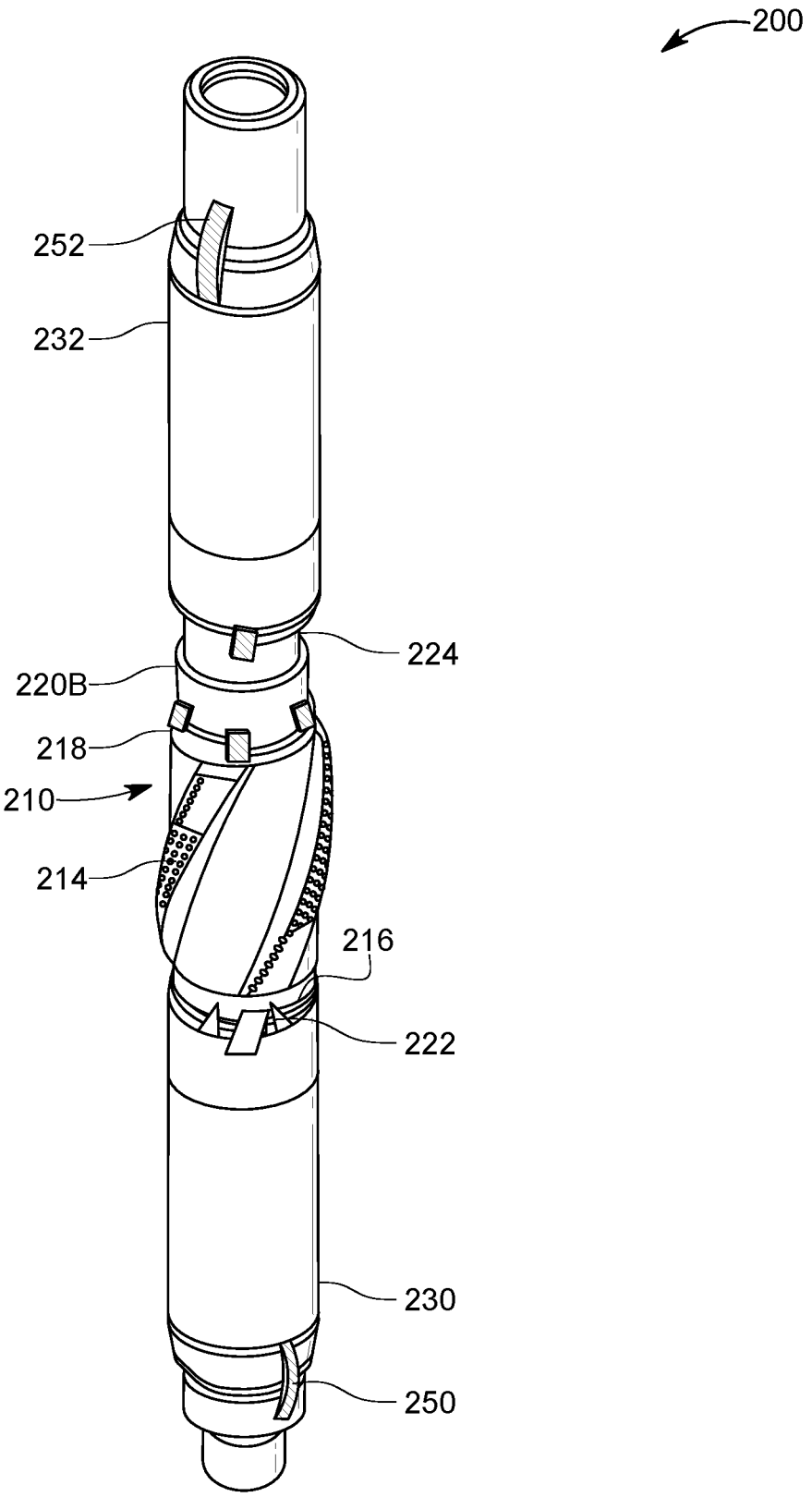
FIG. 5 illustrates how a main cutting device is engaged by a first housing when the tool is removed from the well.
Figure 6:
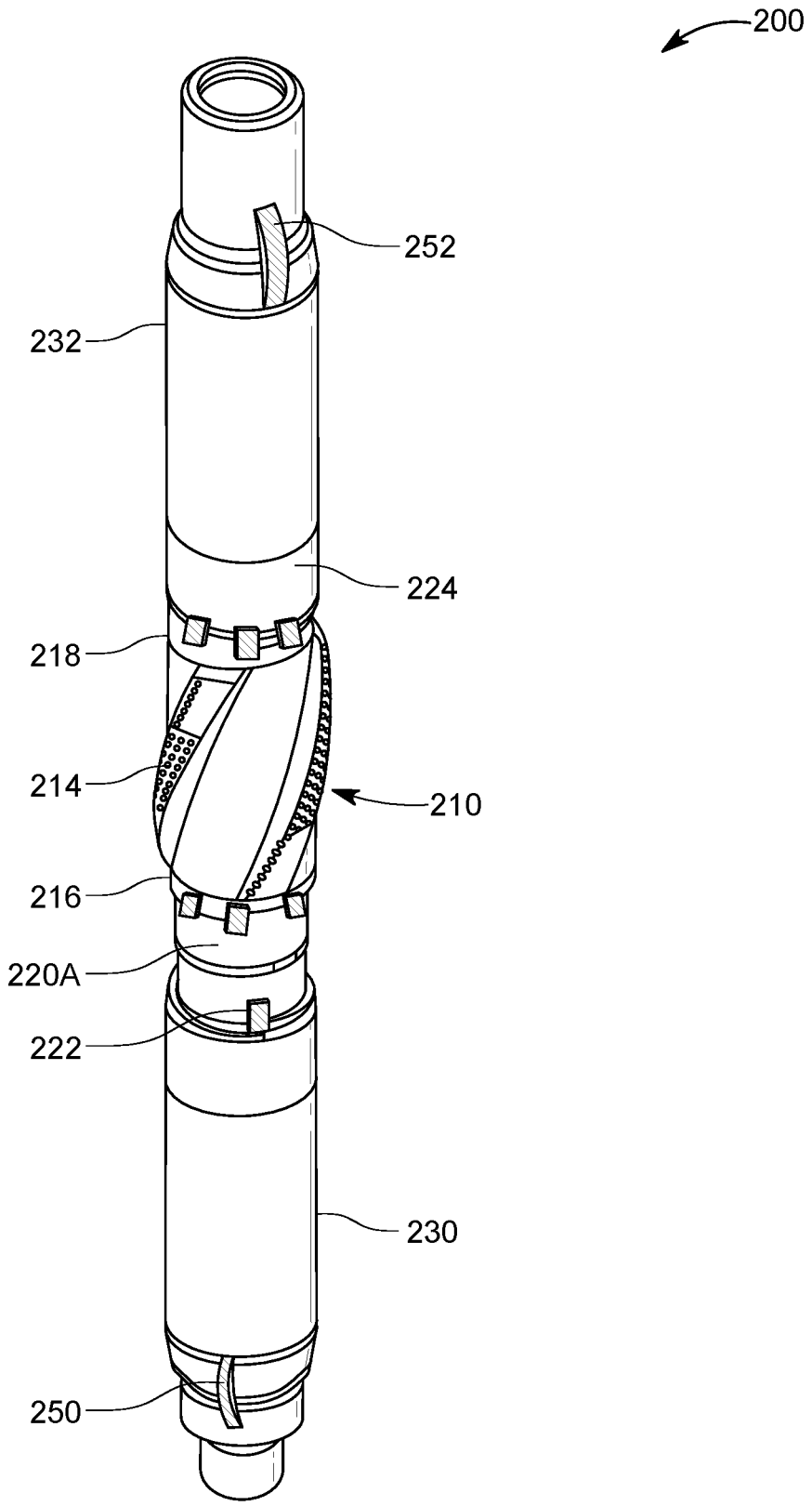
FIG. 6 illustrates how the main cutting device is engaged by a second housing when the tool is lowered into the well.

The proximal engagement elements 216, 218 and the distal engagement elements 222, 224 are configured to engage to each other in pairs, when the tool is pushed down or up the well, so that a rotation of the first housing 230 or a rotation of the second housing 232, also makes the main cutting device 210 to rotate when the corresponding proximal and distal engagement elements connect to each other. In this respect, note that FIG. 2 shows the proximal and distal engagement elements not being in direct contact with each other, which means that a rotation of the first and second housings 230 and 232, would not make the main cutting device 210 to rotate. However, if for any reason, the main cutting device 210 is caught inside the well, for example, because of the swelling of the well, then an upward movement of the first and second housings 230 and 232, would make the distal engagement element 222 to directly engage with the corresponding proximal engagement element 216 because the main cutting device 210 can slide relative to the shaft, as shown in FIG. 5, and thus, a clockwise rotation of the first housing 230 would make the main cutting device 210 to also rotate, assuming that the teeth of the proximal and distal engagement elements are configured to lock for the clockwise rotation and to slip past each other for an anti-clockwise rotation. Similarly, when the tool 200 moves in a downward direction, toward the toe of the well, and the main cutting device 210 is trapped by the well, for example, due to a constriction in the well, the second housing 232 moves closer to the main cutting device 210 due to the spring device 209, the distal engagement element 224 directly engages the proximal engagement element 218, and the clockwise rotation of the second housing 232 is transmitted to the main cutting device 210, as shown in FIG. 6. An anti-clock rotation of the first or second housings would not make the teeth of the proximal and distal engagement elements to lock, and thus the main cutting device 210 would not rotate.

In other words, when the main cutting device 210 encounters axial resistance sufficient to override the compression of the spring 208 or 209, and the corresponding proximal and distal engagement elements come into engagement with one another as the main shaft slides relative to the main cutting device 210, the main cutting device will be forced into rotation in unison with the shaft 202 and one of the housings 230 or 232 by engagement of the proximal and distal engagements elements, thereby reaming or otherwise conditioning the borehole by application of the full drill string torque to the main drilling device 210 as the drilling process continues.

Figure 7A:
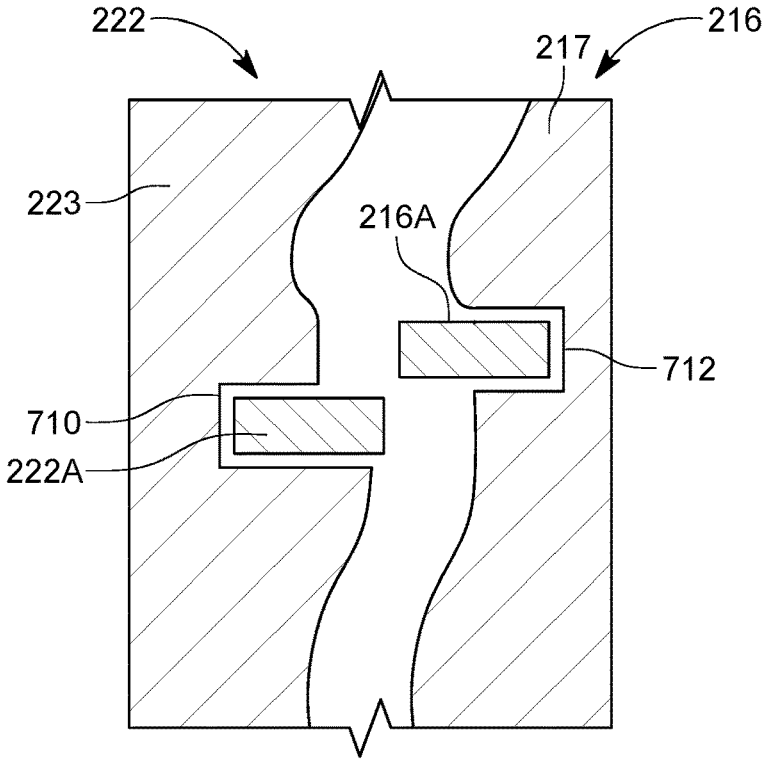
FIGS. 7A and 7B illustrate an engagement mechanism between the main cutting device and the first and second housings.
Figure 7B:
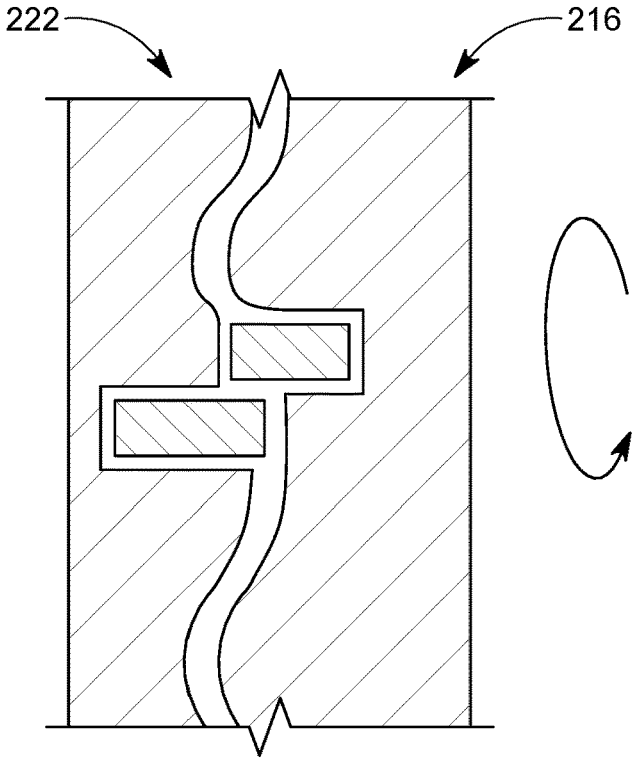

The proximal and distal engagement elements are now discussed in more detail with regard to FIGS. 7A and 7B. FIG. 7A shows the distal engagement element 222 spaced apart from the proximal engagement element 216 while FIG. 7B shows the two elements being locked together. Each of these two elements include a corresponding insert 222A, 216A, which is replaceable attached to the body 223, 217 of the elements, respectively. In other words, the body 223 of the distal engagement element has a recess 710 and the insert 222A is configured to fit inside the recess 710. In one embodiment, the insert 222A is press fit inside the recess 710. In another embodiment, the insert 222A may be fixed to the recess 710 with a screw (not shown). Any method for attaching the insert to the recess may be used as long as the insert can be easily removed when necessary to replace it. While FIGS. 7A and 7B show for simplicity the engagement elements having only one insert, one skilled in the art would understand that any numbers of inserts and corresponding recesses may be used. In one embodiment, the number of inserts and recesses is dictated by the size of the tool, by the force expected to be applied to the main cutting device 210, etc. The insert 216A of the proximal engagement element 216 may similarly be placed into a recess 712. The inserts may be made of a material which is stronger than the body of the engagement element as the inserts would be responsible for absorbing the large forces that appear when the engagement elements suddenly become engaged.

The lips of the engagement elements 222 and 216 are shaped to lock with each other only when they rotate in a given direction (e.g., clockwise), but to slip past each other when they rotate in the opposite direction (e.g., anti-clockwise). In this regard, FIG. 7B shows the distal engagement element 222 being rotated as indicated by the arrow in the figure, which makes the two engagement elements to lock to each other. It is noted that when the engagement elements are locked to each other, the inserts 222A and 216A are in direct contact with each other, and most of the load due to the rotation is absorbed by the inserts. This means that during operation of the tool, when the inserts become damaged, the engagement elements may be quickly and cheaply reconditioned by just replacing the damaged inserts, which is advantageous. Thus, the addition of the inserts shown in FIGS. 7A and 7B improve the tool's life, as these inserts may be made of a material that is more stress resistant than the material from which the engagement elements are made. Three to five inserts per engagement element are used in this embodiment, but another number of inserts may be used.

Figure 8A:
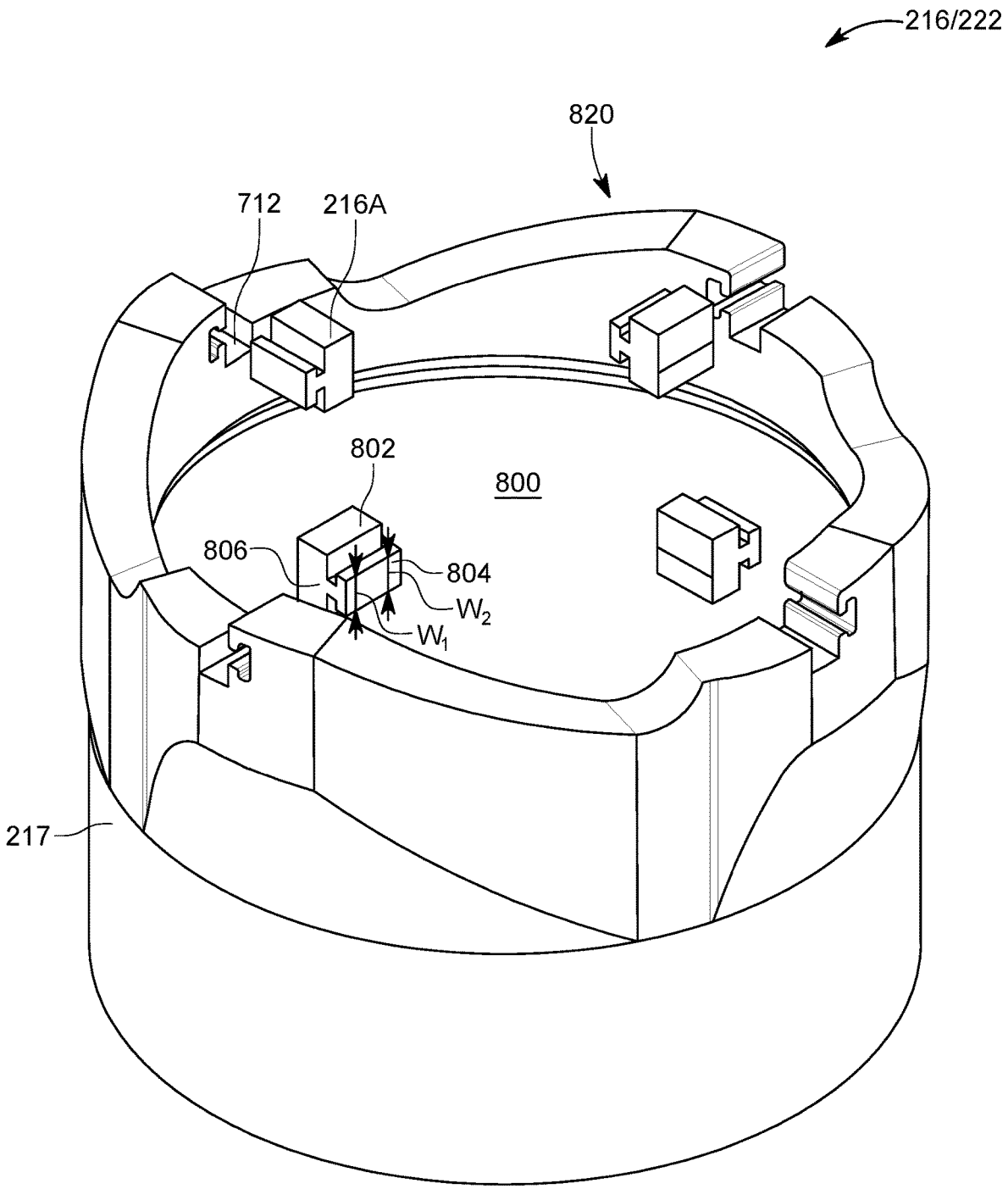
FIGS. 8A and 8B illustrate another engagement mechanism between the main cutting device and the first and second housings.
Figure 8B:
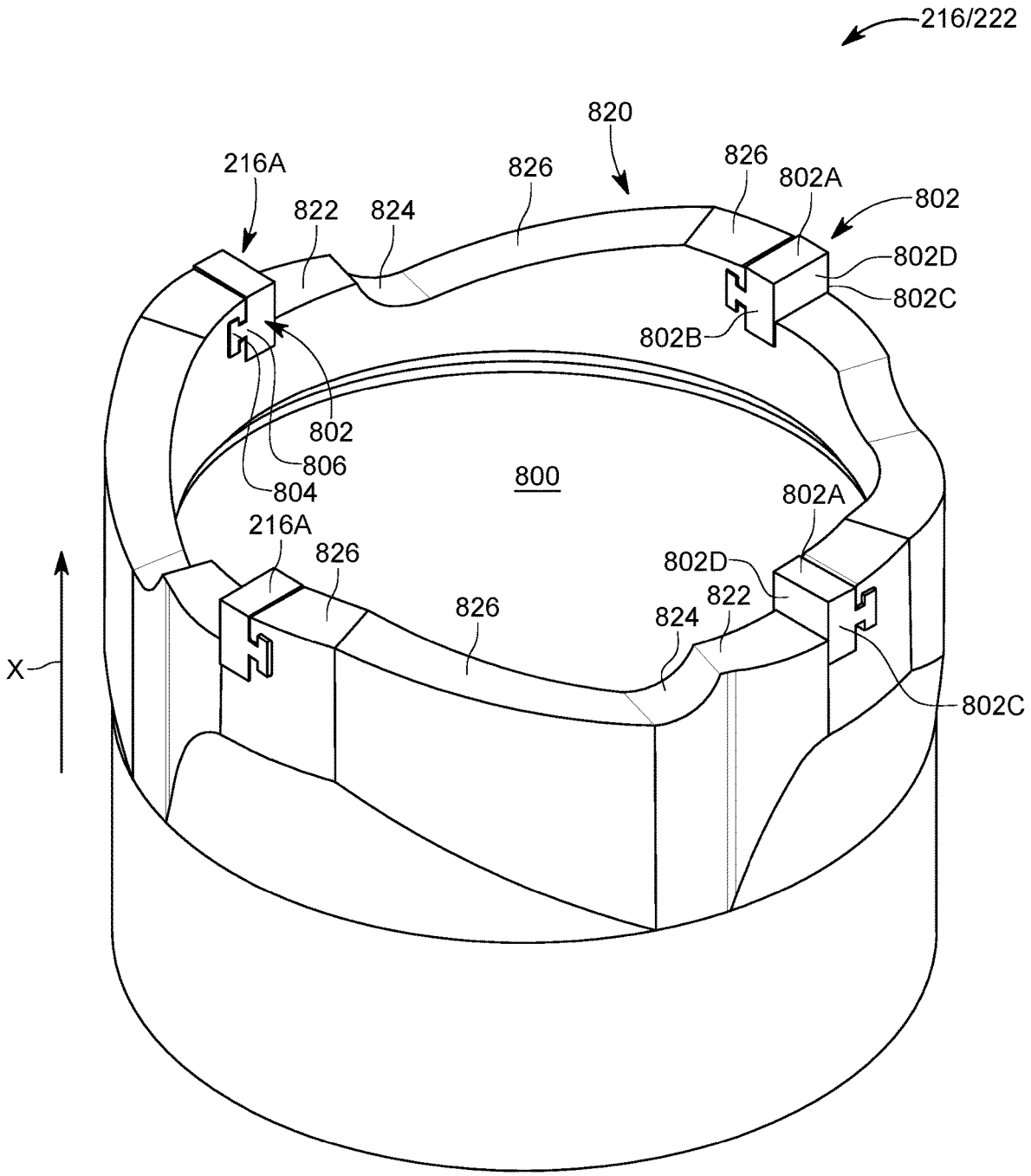

FIGS. 8A and 8B illustrate an embodiment in which the engagement profile of the proximal and distal engagement elements are identical and the inserts slide into the recesses and stay there as only a part of the insert enters the recess. More specifically, FIG. 8A shows the proximal engagement element 216 (or the distal engagement element 222) having the insert 216A shaped to have a T cross-section, and the recess 712, shaped accordingly, to tightly mate with a portion of the insert 216A. This means that in this embodiment, the insert 216A has a first part 802 (impact part, as this part takes the full brunt of the impact with the corresponding insert from the other engagement element) that is shaped as a rectangular prism, a second part 804 (the holding part, as this part holds the insert inside the recess) that is also shaped as a rectangular prism, but having a smaller width, and a third part 806 (joining part, as this part joints the impact part to the holding part), that joins the first part 802 to the second part 804. The joining part 806 has an even smaller width than the holding part 804. The insert 216A is configured to be inserted into the recess 712, from inside the bore 800 of the element 216, as shown in FIG. 8A. After the insert 216A is fully inserted into the recess 712, the engagement element 216 looks like in FIG. 8B. In one application, to prevent the insert 216A to exit the recess 712, at the outside of the element 216, the holding part 806 is shaped like a wedge (i.e., a width W1 at one end being smaller than a width W2 at the other end), and the recess 712 is also shaped like a wedge, so that the insert 216A cannot move past a given point inside the recess 712.

The lip 820 (or profile) of the proximal engagement element 216, which directly engages the lip (not shown) of the distal engagement element 222, is shaped, in the embodiment illustrated in FIGS. 8A and 8B, to fully expose three faces 802A to 802C of the impact part 802, and partially expose another face 802D of the impact part 802, as best illustrated in FIG. 8B. The lip 820 includes a first flat region 822, which contacts the engagement element, a second curved region 824, which connects to the first flat region 822, a third slopping portion 826, which connects to the curved region 824, and a fourth flat region 826, which connects to the third slopping portion 826, and the face 802A of the next insert 216A. Note that the fourth flat region 826 is flush with the face 802A of the next insert 216A while the first flat region 822 is located, along the longitudinal axis X, between the face 802A and an opposite face of the inset 216A.

These four regions repeat between two adjacent inserts, as shown in FIG. 8B. In this embodiment, the fourth flat region 826 is higher than the first flat region 822, along the longitudinal axis X, and the second curved region 824 has a radius of curvature smaller than the third slopping region 826. The profile of the lip of the proximal engagement element 216 may be identical for the other proximal engagement element 218 and also for the distal engagement elements 222 and 224. Other profiles may be used as long as the inserts from one engagement element directly lock with the inserts from the other engagement element when the engagement element is rotated in one direction, but do not lock when rotated in the opposite direction.

Figure 9:
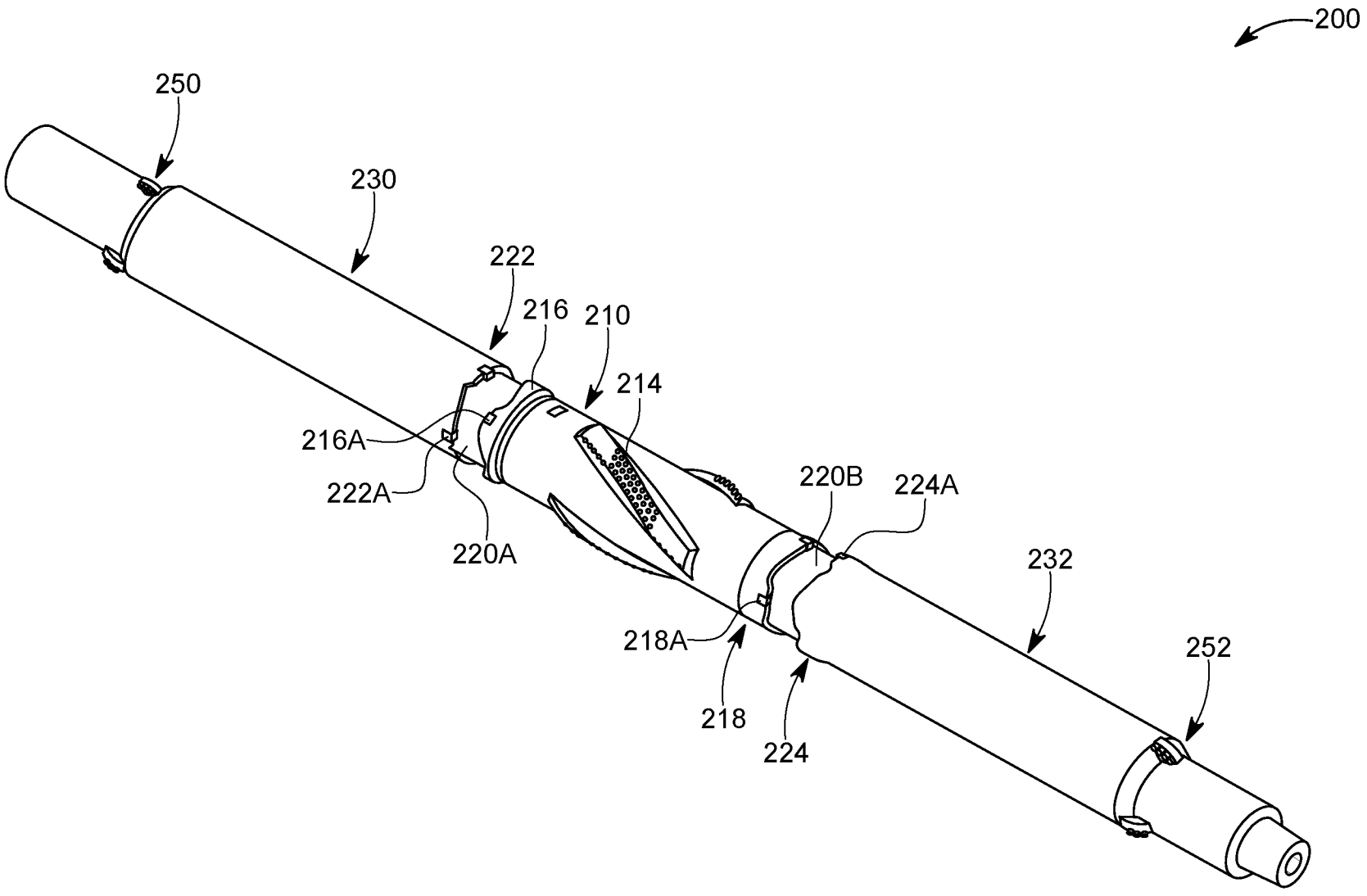
FIG. 9 shows the novel multifunction drilling enhancement tool having the engagement mechanism illustrated in FIGS. 8A and 8B.

The tool 200 having the engagement elements with the inserts (or teeth) illustrated in FIGS. 8A and 8B, is shown in FIG. 9. FIG. 9 shows the first and second distal engagement elements 222, 224 attached to corresponding ends of the first and second housings 230, 232, so that the first distal engagement element 222 is directly facing the first proximal engagement element 216, and the second distal engagement element 222 is directly facing the second proximal engagement element 216. Further, FIG. 9 shows that the first distal engagement element 222 has inserts 222A (similar to insert 216A discussed in FIGS. 8A and 8B), the second distal engagement element 224 has inserts 224A (similar to insert 216A discussed in FIGS. 8A and 8B), and the second proximal engagement element 218 has inserts 218A (similar to insert 216A discussed in FIGS. 8A and 8B).

Note that the proximal and distal engagement elements may be attached to their corresponding main cutter device 210 or housings 230 and 232 by various means, for example, press-fit, welding, screws, or threads. This embodiment shows the tool having four inserts 216A per engagement element, consistent with the engagement elements shown in FIGS. 8A and 8B. As previously discussed, the number of inserts and/or the shape of the lips of the engagement elements may be modified as long as they use mainly (in one embodiment, exclusively) the inserts 216A to achieve the locking between two different engagement elements. In this way, the damage associated with the sudden engagement of the proximal and distal engagement elements is transferred mainly to the inserts, which can then easily be replaced, when damaged.

The tool 200 can be used for many purposes in a well. For example, after drilling a well, traditionally, it is necessary for reaming every stand to eliminate ledging, spiraling, and other bore-hole irregularities. The tool 200 is capable to minimize the need to ream every stand as it acts on the well immediately after the drill bit, thus clearing the hole irregularities and leaving a smoother bore hole in one trip.

In another embodiment, it is necessary to use a tool to perform hard back-reaming through a swelling shale and other types of tight spots while pulling it out of the hole. In this case, the tool would minimize the back reaming time by providing a more efficient back reaming with PDC cutters as compared to the blunt stabilizer. When facing any tight spots, the tool body would engage the spots and the PDC cutters 252 would start to efficiently ream through the tight spot. As the tool 200 comes in full gauge and on top of the bottom hole assembly (BHA) above all stabilizers and reamers, the rest of the BHA elements should follow smoothly after the tool does the back-reaming.

The tool may also be used to reduce or eliminate the wiper trips, which are typically performed after a section is completed, to adjust the bore hole condition and eliminate hole irregularities for smoother casing run. In this regard, note that prior to deploying the casing, after drilling the well, the walls of the well need to make a smooth, constant diameter bore or otherwise the casing will not slide inside the well. Thus, the tool 200 in the BHA may minimize the need for wiper trips as the tool performs all the bore hole shape/size adjustments while drilling and while pulling it out of the well.

It is also possible, in a typical well, to have a completely stuck pipe in the well due to the tight spots and thus, the drill line is jarred and/or over-pulled to free the stuck pipe. The tool 200's presence in the BHA should minimize the potential of such drilling problems as the tool 200 has the ability to drill through the tight spots. Conventional stabilizers on the other hand are not equipped with any cutting structures so they can easily get jammed into the tight spot.

Because the tool 200 has the cutting structures rotating on bearings, it greatly reduces the BHA torque and BHA stick-slip, allowing to apply higher weight on bit and drilling parameters to achieve higher rate of penetration values for more economic drilling.

Figure 1:
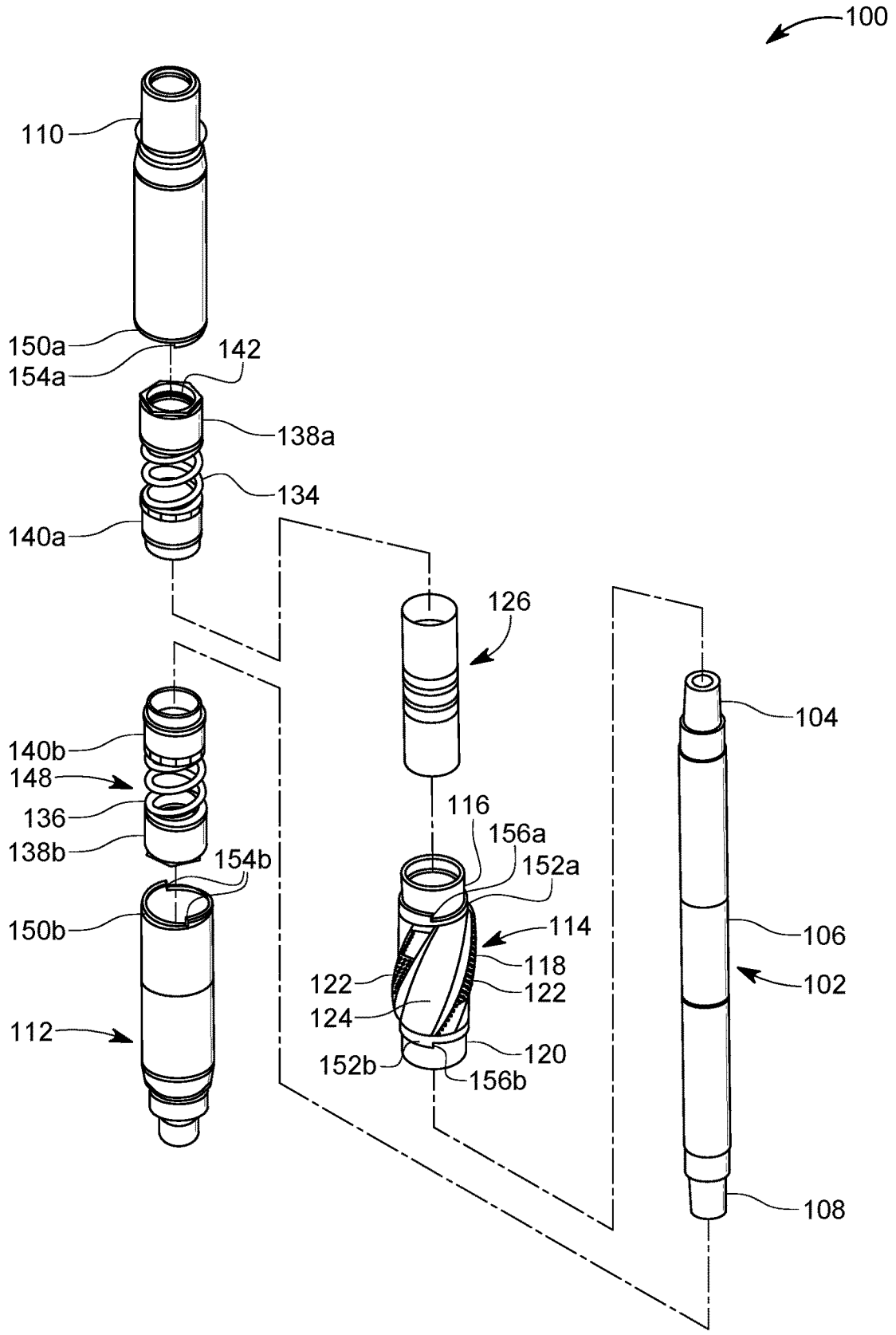
FIG. 1 is a schematic diagram of a multifunction wellbore conditioning tool.
Figure 10:
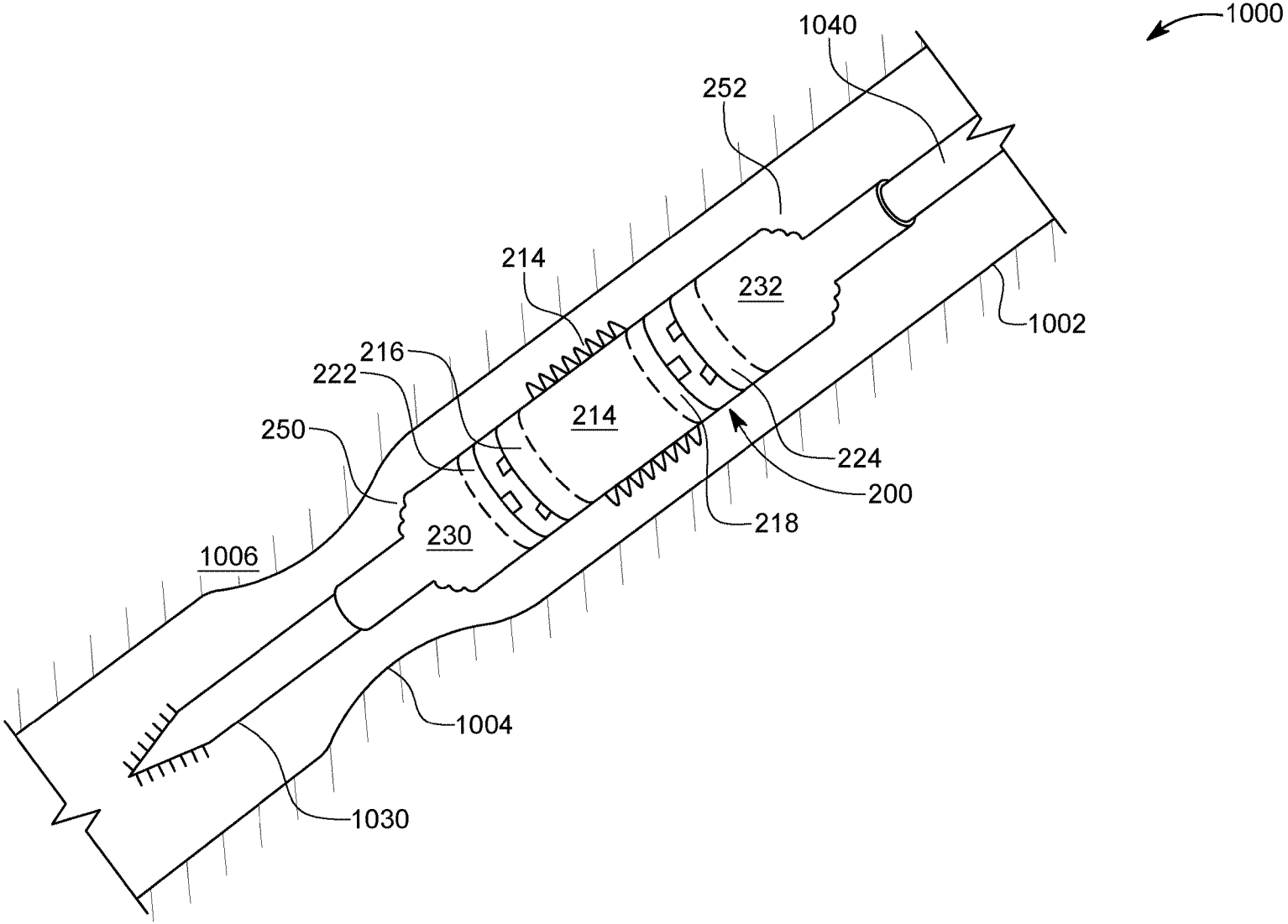
FIG. 10 shows the novel multifunction drilling enhancement tool deployed in the well and removing a constriction of the well.

When the tool 200 is placed inside a well, as shown in FIG. 10, one or more of the following advantages can be obtained. FIG. 10 shows a well 1002 that has a constriction 1004. The constriction 1004 may be due to, for example, the swelling of the earth formation 1006. This means, that an inner diameter of the well, after being cut by a drill element 1030, has decreased so that the drill line 1040 might not fit through the constriction 1004. Note that in this embodiment, the drill element 1030 has already passed the zone where the constriction 1004 has occurred, and cannot go back to remove the constriction. Also note that the system 1000 has the tool 200 connected between the drill element 1030 and the drill line 1040. A traditional reaming device, has cutting elements disposed only on the side of the tool, as shown in FIG. 1. However, to get the cutting elements to the constriction 1004 may be difficult. The tool 200, because of the secondary cutting elements 250, 252, that are formed starting on the smaller diameter of the housings 230 and 232, are a perfect fit for the constriction 1004. Because the housing 230 and 232 are fixedly attached to the shaft 202, the secondary cutting elements 250 and 252 are in permanent rotation as long as the drill line 1040 rotates. Thus, the constriction 1004 can be removed, in a first phase, with the secondary cutting elements 250 and 252, and when the main cutting device 210 arrives at what is left of the constriction, so that the full extent of the constriction can be removed.

Figure 11:
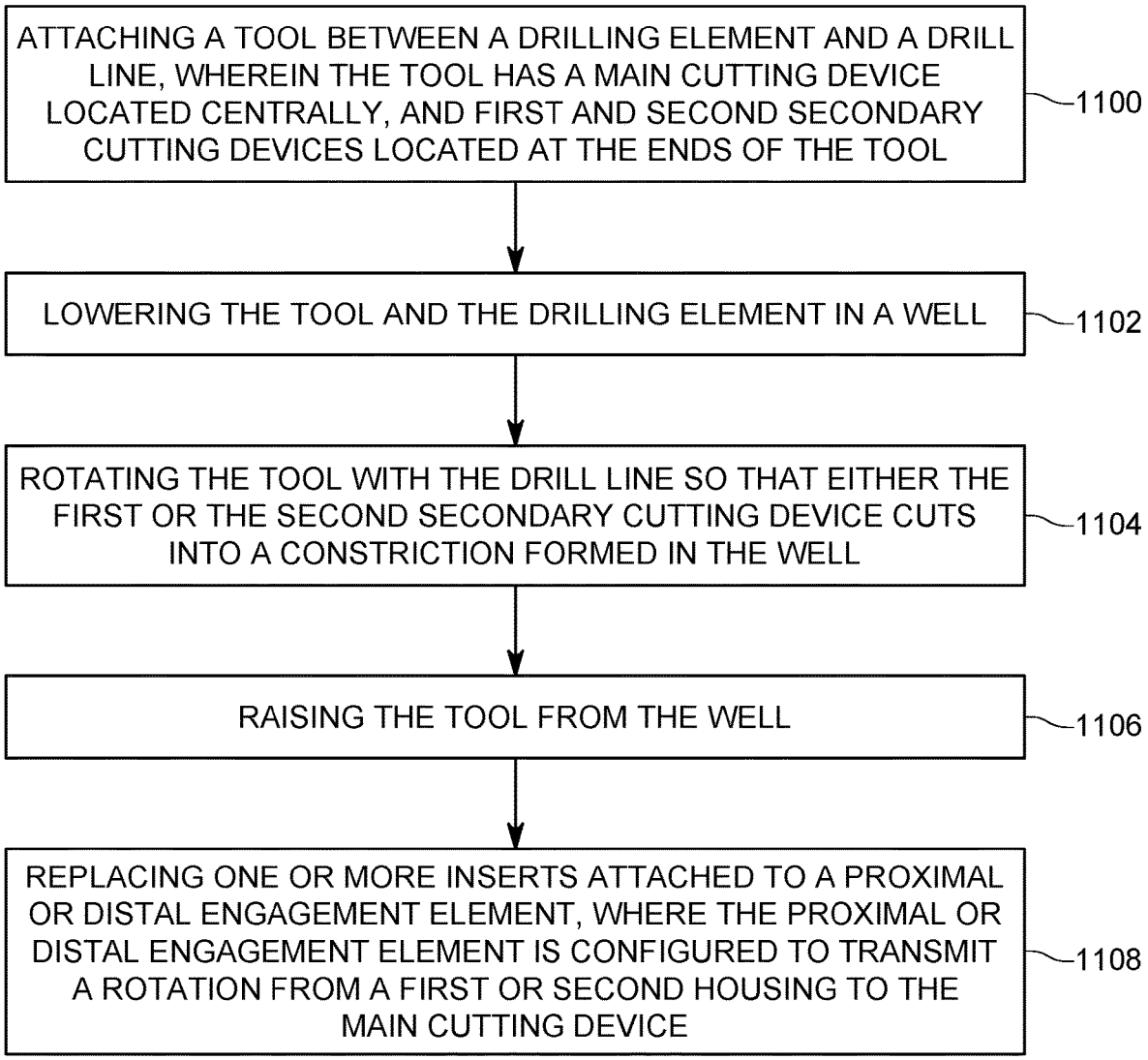
FIG. 11 is a flow chart of a method for using the novel multifunction drilling enhancement tool for conditioning the well.

A method for conditioning a drill hole in a well is now discussed with regard to FIG. 11. The method includes a step 1100 of attaching the tool 200 between the drilling element 1030 and the drill line 1040, wherein the tool 200 has a main cutting device 210 located centrally, and first and second secondary cutting devices 250, 252 located at the ends of the tool 200, a step 1102 of lowering the tool 200 and the drilling element 1030 in the well 1002, a step 1104 of rotating the tool 200 with the drill line 1040 so that either the first or the second secondary cutting device cuts into a constriction formed in the well, a step 1106 of raising the tool 200 from the well, and a step 1108 of replacing one or more inserts 216A attached to a proximal or distal engagement element 216, 218, 222, 224, where the proximal or distal engagement element 216, 218, 222, 224 is configured to transmit a rotation from a first or second housing 230, 232 to the main cutting device 210.

The disclosed embodiments provide a multifunctional drilling enhancement tool that is capable of achieving one or more functions performed by individual traditional devices, e.g., reaming, wiper trips, minimizing stuck pipes, and increasing the rate of production. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A multifunctional drilling enhancement tool, comprising:

a shaft having a bore extending along a longitudinal direction (X);

a main cutting device rotatably and slidably attached to the shaft;

a first housing fixedly attached to a first end of the shaft;

a second housing fixedly attached to a second end of the shaft;

first and second proximal engagement elements attached to opposite ends of the main cutting device; and first and second distal engagement elements attached to corresponding ends of the first and second housings, so that the first distal engagement element is directly facing the first proximal engagement element, and the second distal engagement element is directly facing the second proximal engagement element, wherein the first distal engagement element has removable first distal inserts, the first proximal engagement element has removable first proximal inserts, and the first distal inserts are configured to directly contact the first proximal inserts to transmit a rotation from the first housing to the main cutting device.

2. The tool of claim 1, wherein the second distal engagement element has removable second distal inserts, the second proximal engagement element has removable second proximal inserts, and the second distal inserts are configured to directly contact the second proximal inserts to transmit a rotation from the second housing to the main cutting device.

3. The tool of claim 1, further comprising:

a first protective sleeve distributed along the shaft, partially within the first distal engagement element and partially within the first proximal engagement element.

4. The tool of claim 3, further comprising:

a second protective sleeve distributed along the shaft, partially within the second distal engagement element and partially within the second proximal engagement element.

5. The tool of claim 1, further comprising:

a first secondary cutting device formed on an outside of the first housing; and a second secondary cutting device formed on an outside of the second housing.

6. The tool of claim 5, wherein each of the first secondary cutting device, the second secondary cutting device, and the main cutting device includes cutting elements.

7. The tool of claim 5, wherein the first secondary cutting device is formed along the first housing, at a location where an external diameter of the first housing changes from a first value to a second value, which is different from the first value.

8. The tool of claim 7, wherein the second secondary cutting device is formed along the second housing, at a location where an external diameter of the second housing changes from the first value to the second value.

9. The tool of claim 1, further comprising:

a first radial bearing device fixedly attached to the shaft and configured to support a first end of the main cutting device; and a second radial bearing device fixedly attached to the shaft and configured to support a second end of the main cutting device, wherein the first and second radial bearing devices are configured to rotate relative to the shaft and also to slide relative to the shaft.

10. The tool of claim 1, further comprising:

a first axial bearing system attached to the shaft so that an outer race rotates relative to the shaft, and the outer race is attached to an inside of the first housing; and a second axial bearing system attached to the shaft so that an outer race rotates relative to the shaft, and the outer race is attached to an inside of the second housing.

11. The tool of claim 10, further comprising:

a first spring device placed along the shaft, and extending between the first axial bearing system and the main cutting device; and a second spring device placed along the shaft, and extending between the second axial bearing system and the main cutting device.

12. The tool of claim 11, wherein the first and second spring devices are configured to hold the main cutting device centered between the first and second housings, and the first and spring devices are not fixedly attached to the shaft.

13. A multifunctional drilling enhancement tool, comprising:

a main cutting device rotatably and slidably attached to a shaft;

a first housing fixedly attached to a first end of the shaft;

a second housing fixedly attached to a second end of the shaft;

a first secondary cutting device formed on an outside of the first housing;

a second secondary cutting device formed on an outside of the second housing;

first and second proximal engagement elements attached to opposite ends of the main cutting device; and first and second distal engagement elements attached to corresponding ends of the first and second housings, wherein the first distal engagement element has removable first distal inserts, the first proximal engagement element has removable first proximal inserts, and the first distal inserts are configured to directly contact the first proximal inserts to transmit a rotation from the first housing to the main cutting device.

14. The tool of claim 13, wherein the first secondary cutting device is formed along the first housing, at a location where an external diameter of the first housing changes from a first value to a second value, which is different from the first value, and wherein the second secondary cutting device is formed along the second housing, at a location where an external diameter of the second housing changes from the first value to the second value.

15. The tool of claim 13, wherein the second distal engagement element has removable second distal inserts, the second proximal engagement element has removable second proximal inserts, and the second distal inserts are configured to directly contact the second proximal inserts to transmit a rotation from the second housing to the main cutting device.

16. The tool of claim 13, further comprising:

a first protective sleeve distributed along the shaft, partially within the first distal engagement element and partially within the first proximal engagement element; and a second protective sleeve distributed along the shaft, partially within the second distal engagement element and partially within the second proximal engagement element.

17. The tool of claim 16, further comprising:

a first radial bearing device fixedly attached to the shaft and configured to support a first end of the main cutting device; and a second radial bearing device fixedly attached to the shaft and configured to support a second end of the main cutting device, wherein the first and second radial bearing devices are configured to rotate relative to the shaft and also to slide relative to the shaft.

18. The tool of claim 17, further comprising:

a first axial bearing system attached to the shaft so that an outer race rotates relative to the shaft, and the outer race is attached to an inside of the first housing;

a second axial bearing system attached to the shaft so that an outer race rotates relative to the shaft, and the outer race is attached to an inside of the second housing;

a first spring device placed along the shaft, and extending between the first axial bearing system and the main cutting device; and a second spring device placed along the shaft, and extending between the second axial bearing system and the main cutting device, wherein the first and second spring devices are configured to hold the main cutting device centered between the first and second housings, and the first and spring devices are not fixedly attached to the shaft.

19. A method for conditioning a drill hole in a well, the method comprising:

attaching a tool between a drilling element and a drill line, wherein the tool has a main cutting device located centrally which is rotatably and slidably attached to a shaft, and first and second secondary cutting devices located at ends of the tool;

lowering the tool and the drilling element in a well;

rotating the tool with the drill line so that either the first or the second secondary cutting device cuts into a constriction formed in the well;

raising the tool from the well; and replacing one or more inserts on a proximal or distal engagement element, wherein the one or more inserts on the proximal or distal engagement element is configured to transmit a rotation from a first or second housing to the main cutting device when the proximal engagement element engages the distal engagement element.

* * * * *